US009556563B1

(12) United States Patent
Yang

(10) Patent No.: US 9,556,563 B1
(45) Date of Patent: Jan. 31, 2017

(54) PAPER PULP MOLDING DEVICE

(71) Applicant: Hui-Ping Yang, Taichung (TW)

(72) Inventor: Hui-Ping Yang, Taichung (TW)

( * ) Notice: Subject to any disclaimer, the term of this patent is extended or adjusted under 35 U.S.C. 154(b) by 0 days.

(21) Appl. No.: 14/989,860

(22) Filed: Jan. 7, 2016

(51) Int. Cl.
*D21J 7/00* (2006.01)
*D21J 3/10* (2006.01)

(52) U.S. Cl.
CPC ..... *D21J 3/10* (2013.01)

(58) Field of Classification Search
CPC ..... D21J 7/00; D21J 3/00; D21J 5/00
USPC ..... 162/410
See application file for complete search history.

(56) References Cited

U.S. PATENT DOCUMENTS 3,850,793 A * 11/1974 Hornbostel ..... D21J 5/00 162/228
3,864,206 A * 2/1975 Linderoth ..... B29C 44/14 156/245
3,922,191 A * 11/1975 Witt ..... D21J 7/00 162/383
5,399,243 A * 3/1995 Miyamoto ..... D21J 7/00 162/199
5,424,026 A * 6/1995 Tohbo ..... B27N 5/02 264/109
5,431,784 A * 7/1995 Miyamoto ..... D21J 7/00 162/272
5,656,135 A * 8/1997 Baker ..... D21J 7/00 162/388
5,745,971 A * 5/1998 Ohsawa ..... B29C 51/28 264/510
6,576,089 B1 * 6/2003 Sato ..... D21J 3/10 162/227
6,706,151 B1 * 3/2004 Oosthuizen ..... D21J 5/00 162/116
7,014,452 B2 * 3/2006 Lee ..... B31B 43/00 425/407
8,235,695 B2 * 8/2012 Kiuchi ..... G03F 9/7003 425/174.4
8,647,093 B2 * 2/2014 Stockhaus ..... D21J 3/00 162/226
2013/0115397 A1 * 5/2013 Holmes ..... B65D 65/466 428/35.6
2013/0228301 A1 * 9/2013 Lang ..... D21J 3/00 162/231
2014/0150984 A1 * 6/2014 Nishikawa ..... B22C 9/00 164/7.1

* cited by examiner

*Primary Examiner* — Mark Halpern
(74) *Attorney, Agent, or Firm* — Huffman Law Group, PC

(57) ABSTRACT

A paper pulp molding device has a reversing demolding mechanism and a vacuum set. The reversing demolding mechanism has a transmission set and at least one suction set. The at least one suction set is rotatable and driven by the transmission set. Each one of the at least one suction set has multiple sucking structures. Each sucking structure has a hollow unit and a vacuum suction disc communicating with the hollow unit. The vacuum set has a vacuum apparatus and multiple hoses. Each hose respectively communicates with the hollow unit of one of the sucking structures and the vacuum apparatus. The vacuum suction disc of each sucking structure enlarges the contact area between the vacuum suction disc and a container to reinforce the suction force produced by the vacuum apparatus.

5 Claims, 11 Drawing Sheets

PAPER PULP MOLDING DEVICE

BACKGROUND OF THE INVENTION

1. Field of the Invention

The present invention relates to a device that is applied for molding recycled paper material into containers, and more particularly to a paper pulp molding device that can reliably demold the molded containers.

2. Description of Related Art

Pulp molding process is a recycling technique that can manufacture containers by discarded paper products. The pulp molding process breaks the discarded paper products into paper pulps, and then adopts the paper pulps to form the containers by compression molding. The pulp molding process not only can resolve the pollution caused by the discarded paper products, but also can reduce the consumptions of timber and decrease deforestation.

With reference to FIG. 10 and FIG. 11, a conventional paper pulp molding device has an upper die 80 and a lower die 90. The upper die 80 has a cavity 81 and multiple channels 82 communicating with the cavity 81. The upper die 80 and the lower die 90 mold the paper pulp into a container C. The container C is left in the cavity 81 of the upper die 80. The conventional paper pulp molding device conducts compressed air into the channels 82 to force the container C to detach from the cavity 81. However, in certain circumstances (such as when the outline of the cavity 81 is complicated), the container C is easily stuck in the cavity 81 and cannot detach from the cavity 81. The container C left in the cavity 81 may interfere with the next manufacturing procedure.

To overcome the shortcomings of the conventional paper pulp molding device, the present invention provides a paper pulp molding device to mitigate or obviate the aforementioned problems.

SUMMARY OF THE INVENTION

The main objective of the present invention is to provide a paper pulp molding device that can improve the reliability of the demolding process.

The paper pulp molding device comprises a reversing demolding mechanism and a vacuum set. The reversing demolding mechanism has a transmission set and at least one suction set. The at least one suction set is rotatable and driven by the transmission set. Each one of the at least one suction set has multiple sucking structures. Each sucking structure has a hollow unit and a vacuum suction disc communicating with the hollow unit. The vacuum set has a vacuum apparatus and multiple hoses. Each hose communicates with the hollow unit of one of the sucking structures and the vacuum apparatus. The vacuum suction disc of each sucking structure enlarges the contact area between the vacuum suction disc and a container to reinforce the suction force produced by the vacuum apparatus.

Other objects, advantages, and novel features of the invention will become more apparent from the following detailed description when taken in conjunction with the accompanying drawings.

DETAILED DESCRIPTION OF PREFERRED EMBODIMENT

Figure 1:
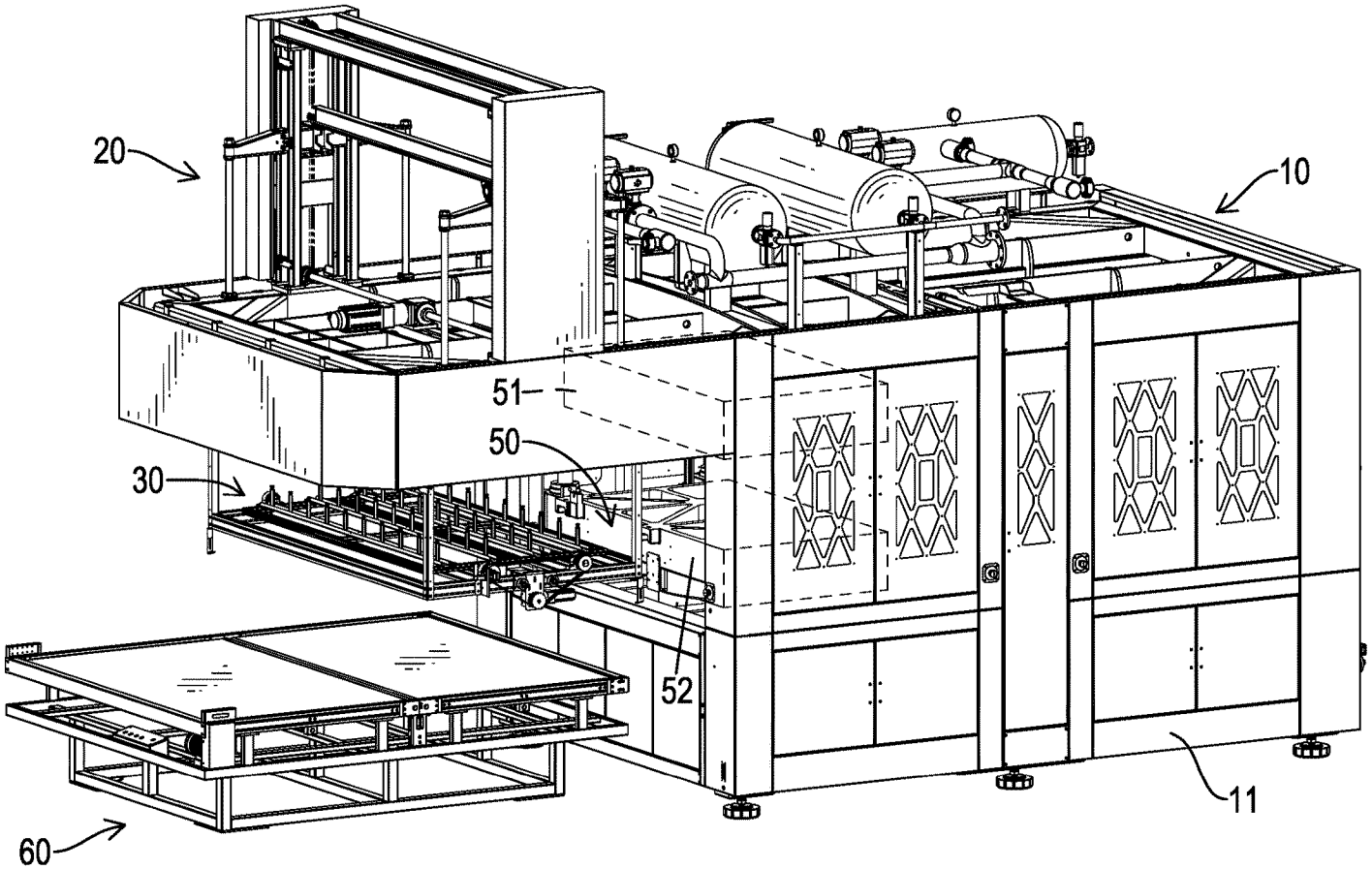
FIG. 1 is a perspective view of a paper pulp molding device in accordance with the present invention.
Figure 2:
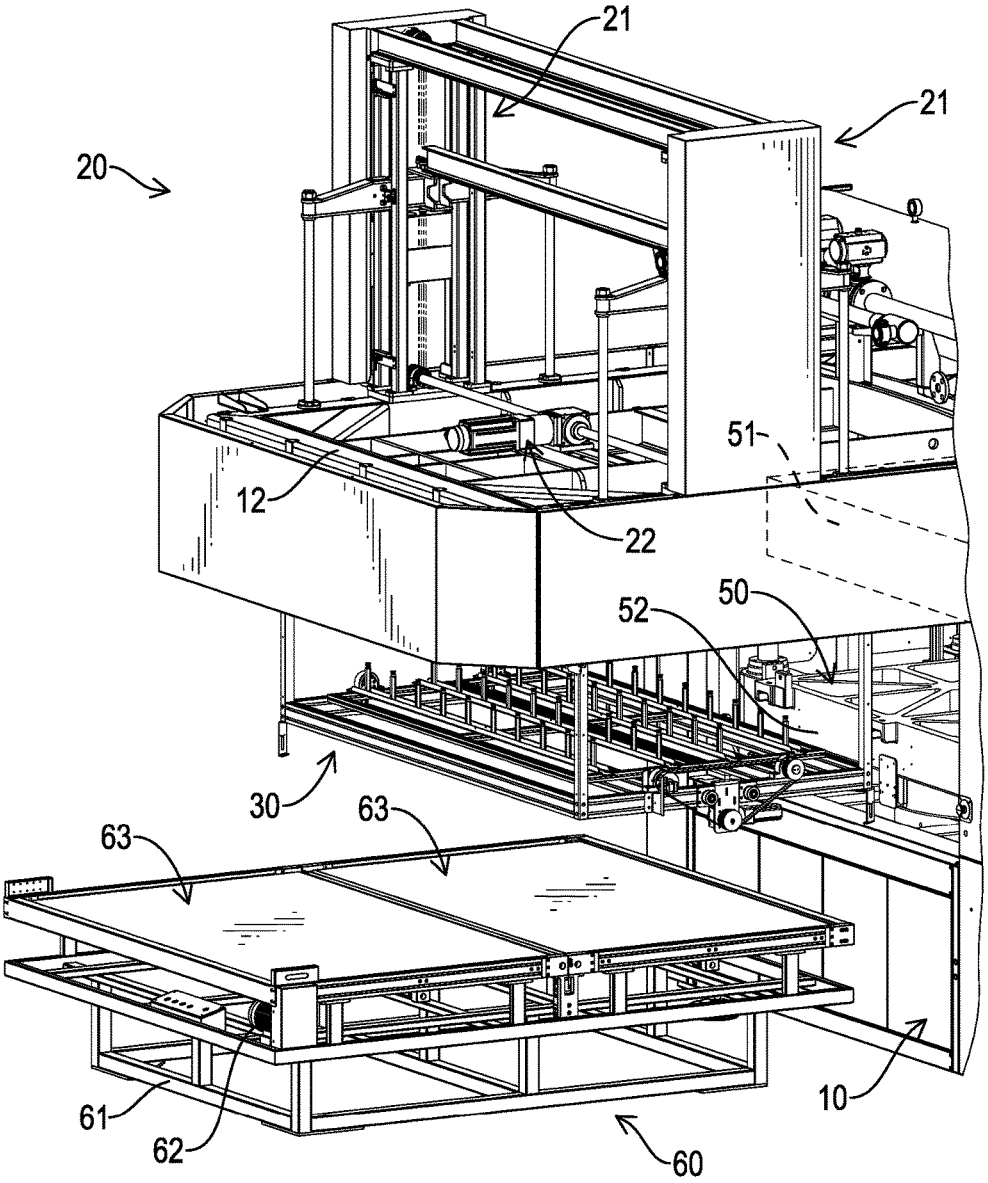
FIG. 2 is a partially enlarged perspective view of the paper pulp molding device in FIG. 1.
Figure 6:
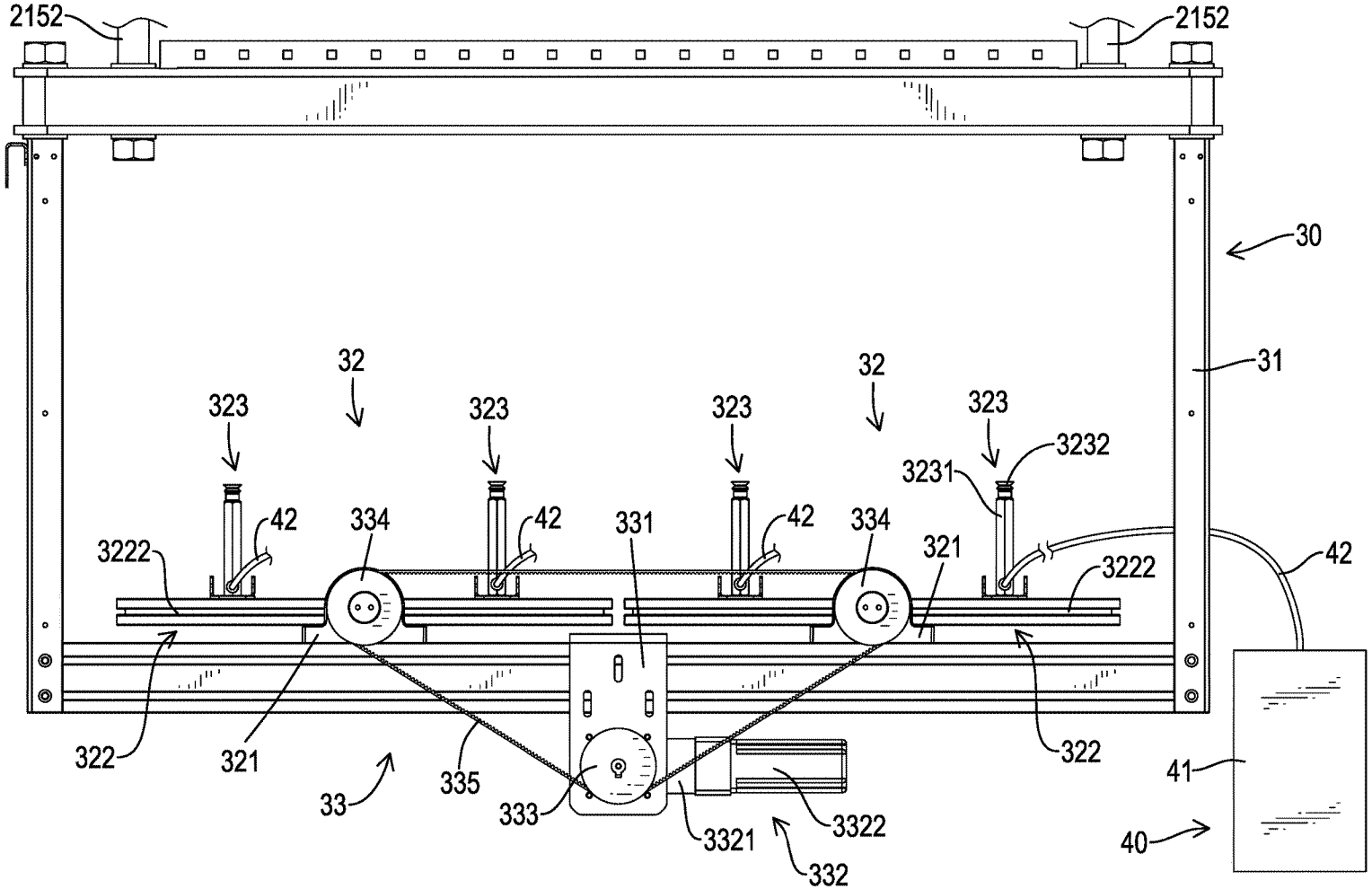
FIG. 6 is an enlarged side view of the reversing mechanism in FIG. 5.

With reference to FIGS. 1, 2, and 6, a paper pulp molding device in accordance with the present invention comprises a molding machine 10, an elevating mechanism 20, and a reversing demolding mechanism 30, a vacuum set 40, a molding mechanism 50, and a conveyor 60.

With reference to FIG. 1 and FIG. 2, the molding machine 10 has a front end, a rear end, a driving side, an operating side, a main body 11, and a supporting frame 12. The front end and the rear end of the molding machine 10 are opposite to each other. The driving side of the molding machine 10 is opposite to the operating side of the molding machine 10. The main body 11 has a top portion and two opposite ends. The supporting frame 12 is assembled on the top portion of the main body 11 and extends toward the front end of the molding machine 10. The supporting frame 12 has two opposite sides.

Figure 3:
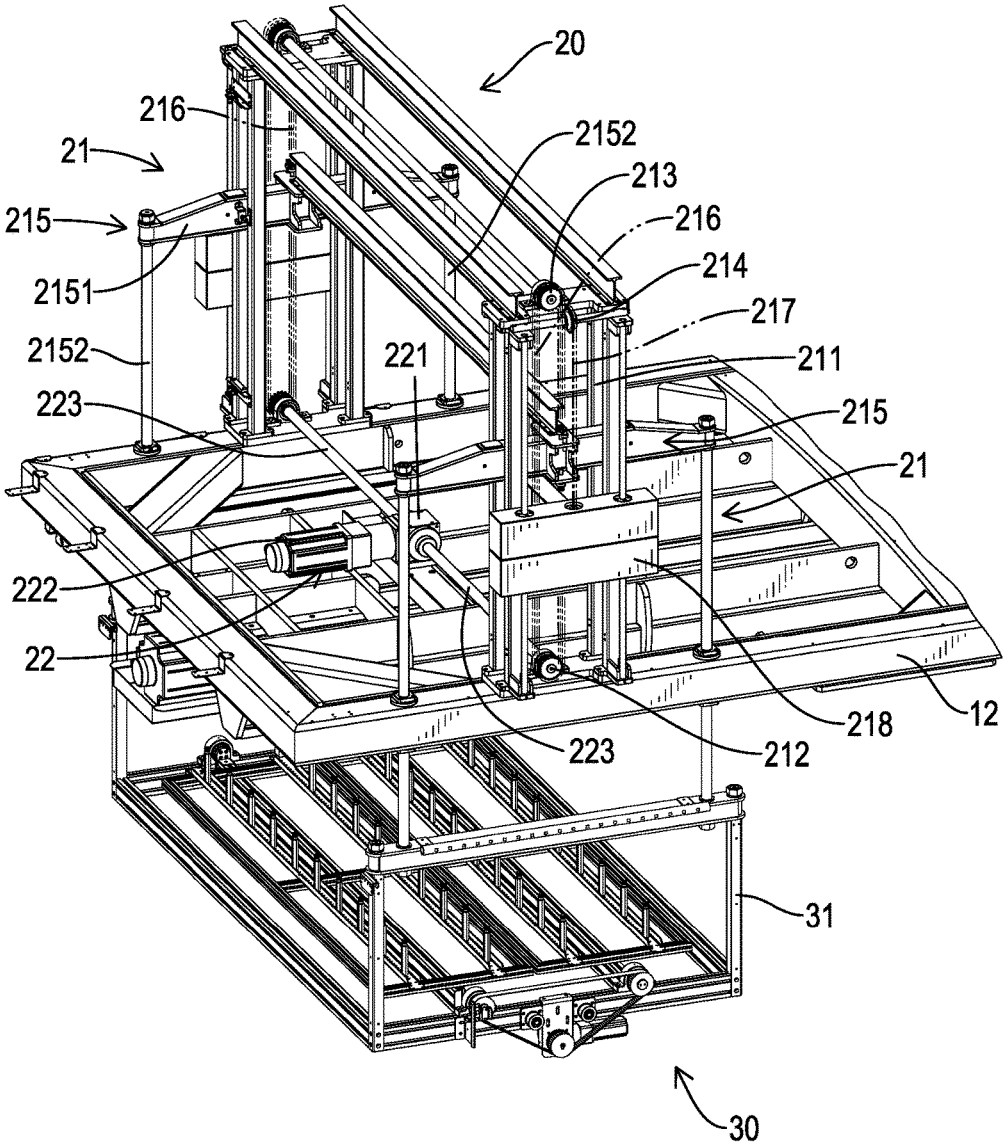
FIG. 3 is an enlarged perspective view of an elevating mechanism of the paper pulp molding device in FIG. 1.
Figure 4:
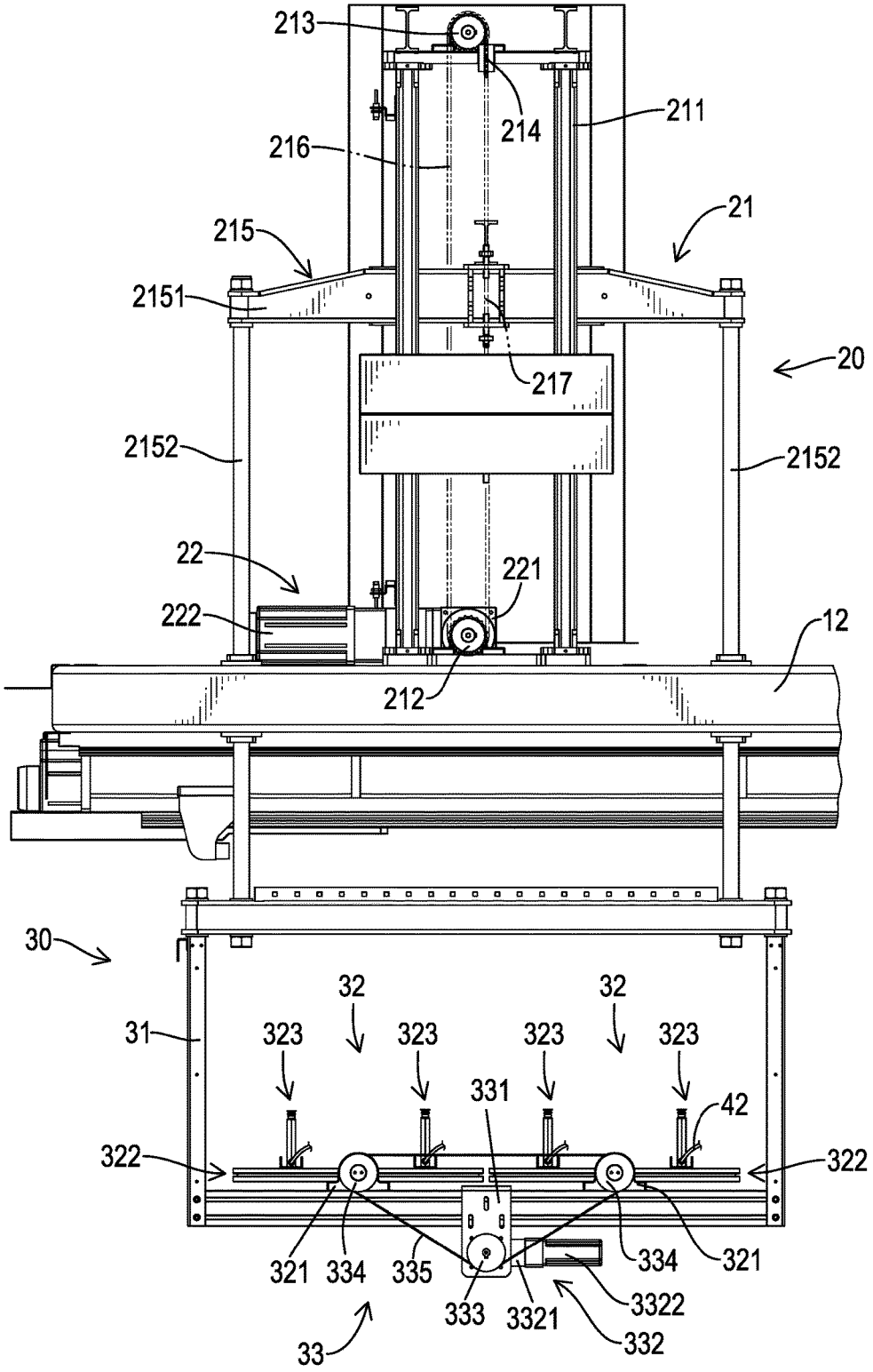
FIG. 4 is an enlarged side view of the paper pulp molding device in FIG. 1.

With reference to FIGS. 2, 3, and 4, the elevating mechanism 20 has two elevating sets 21 and a driving set 22. The two elevating sets 21 are respectively arranged on the two sides of the supporting frame 12. Each elevating set 21 has a standing bracket 211, a first chain wheel 212, a second chain wheel 213, a third chain wheel 214, an elevating rack 215, a first chain 216, a second chain 217, and a balancing member 218. The standing bracket 211 has a lower end and an upper end. The upper end of the standing bracket 211 and the lower end of the standing bracket 211 are opposite each other. The lower end of the standing bracket 211 is connected to the supporting frame 12. The first chain wheel 212 is assembled at the lower end of the standing bracket 211. The second chain wheel 213 is assembled at the upper end of the standing bracket 211. The third chain wheel 214 is assembled at the upper end of the standing bracket 211 and is adjacent to the second chain wheel 213. The two second chain wheels 213 of the two elevating sets 21 are disposed between the two third chain wheels 214 of the two elevating sets 21.

With reference to FIGS. 2, 3, and 4, the elevating rack 215 has a connecting unit 2151 and two connecting poles 2152. The connecting unit 2151 is disposed laterally and has two opposite ends. The two connecting poles 2152 are erectly mounted through the supporting frame 12 and are respectively connected to the two ends of the connecting unit 2151. The first chain 216 has two opposite ends. One of the ends of the first chain 216 is mounted around the first chain wheel 212 and is connected to the connecting unit 2151, and the other end of the first chain 216 is mounted around the second chain wheel 213 and is connected to the connecting unit 2151. The second chain 217 has two opposite ends and is mounted around the third chain wheel 214. One of the ends of the second chain 217 is connected to the connecting unit 2151, and the other end of the second chain 217 is connected to the balancing member 218. The balancing member 218 has several counterweights.

With reference to FIGS. 2, 3, and 4, the driving set 22 has a speed reducer 221, a motor 222, and two driving shafts 223. The speed reducer 221 is assembled on the supporting frame 12. The two driving shafts 223 are respectively connected to the speed reducer 221 and the two first chain wheels 212. The motor 222 is connected with and inputs power into the speed reducer 221. The speed reducer 221 respectively drives the two first chain wheels 212 to rotate through the two driving shafts 223. The two first chain wheels 212 respectively drive the two first chains 216 to move the two elevating racks 215 up and down. Since the two balancing members 218 are respectively connected to the two elevating racks 215 by the two second chains 217, the two balancing members 218 can reduce the load of the driving set 22.

Figure 5:
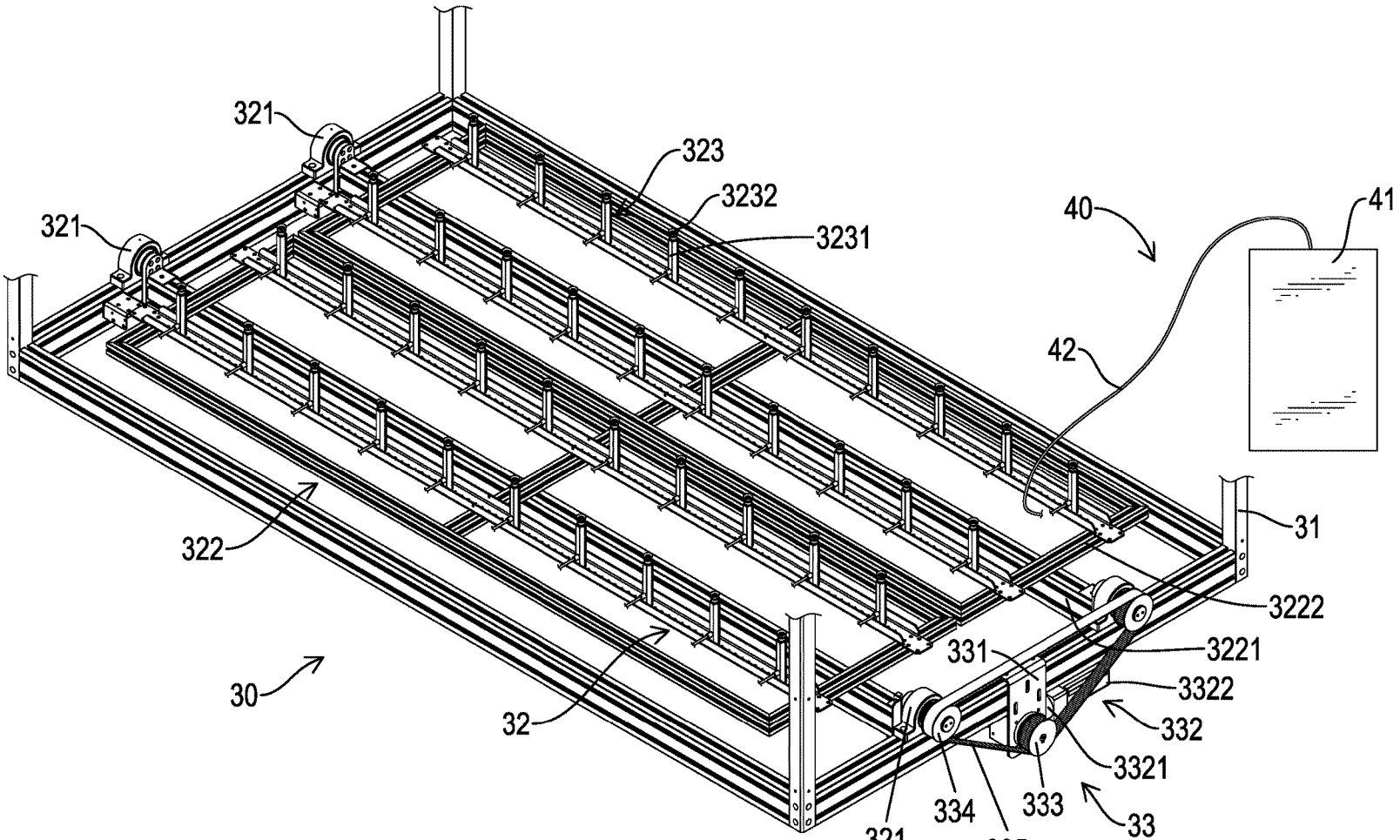
FIG. 5 is an enlarged perspective view of a reversing mechanism of the paper pulp molding device in FIG. 1.

With reference to FIGS. 4, 5, and 6, the reversing demolding mechanism 30 has an assembling height, a mounting rack 31, at least one suction set 32, and a transmission set 33. The mounting rack 31 is assembled on the four connecting poles 2152 of the two elevating racks 215 of the two elevating sets 21. The mounting rack 31 is driven by the elevating mechanism 20 and moves up and down. The mounting rack 31 has two opposite sides.

Figure 7:
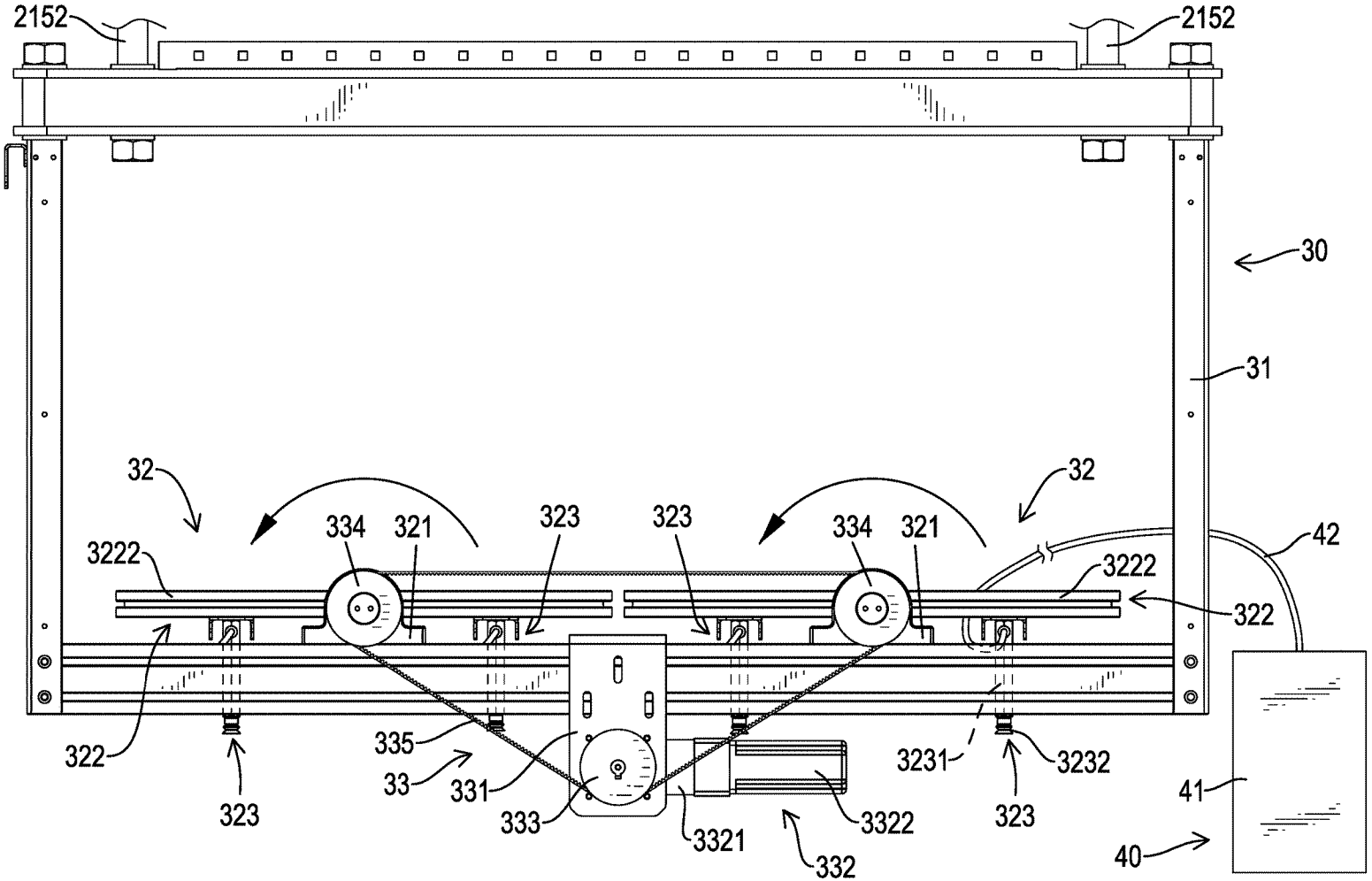
FIG. 7 is an enlarged operational side view of the reversing mechanism in FIG. 5.

With reference to FIGS. 5, 6, and 7, each one of the at least one sucking set 32 has two mounting bearings 321, a reversing rack 322, and multiple sucking structures 323. The two mounting bearings 321 are respectively assembled on the two sides of the mounting rack 31. The reversing rack 322 has a pivot member 3221 and a rack body 3222. The pivot member 3221 has a first end and a second end. The first end of the pivot member 3221 faces to the driving side of the molding machine 10 and is mounted in one of the mounting bearings 321, and the second end of the pivot member 3221 faces to the operating side of the molding machine 10 and is mounted in the other mounting bearing 321. The rack body 3222 is assembled on the pivot member 3221. Each sucking structure 323 has a hollow unit 3231 and a vacuum suction disc 3232. The hollow unit 3221 has two opposite ends. One of the ends of the hollow unit 3231 is connected to the rack body 3222 of the reversing rack 322. The vacuum suction disc 3232 is connected to the other end of the hollow unit 3231 and communicates with the hollow unit 3231.

With reference to FIGS. 5, 6, and 7, the transmission set 33 is disposed on the driving side of the molding machine 10 and has a fixing seat 331, a transmission apparatus 332, a driving unit 333, at least one driven unit 334, and a transmission component 335. The fixing seat 331 is assembled on the mounting rack 31. The transmission apparatus 332 has a transmission decelerator 3321 and a transmission motor 3322. The transmission decelerator 3321 is assembled on the fixing seat 331. The transmission motor 3322 is connected with the transmission decelerator 3321. The driving unit 333 is connected with and driven by the transmission decelerator 3321. Each one of the at least one driven unit 334 is respectively and non-rotatably assembled on the first end of the pivot member 3221 of the reversing rack 322 of each one of the at least one suction set 32. The transmission component 335 is a belt and mounted around the driving unit 333 and the at least one driven unit 334.

With reference to FIGS. 5, 6, and 7, the at least one suction set 32 may be implemented as two in amount. The two suction sets 32 are arranged side by side. The at least one driven unit 334 corresponds in amount to the two suction sets 32 and is also implemented as two. The driving unit 333 and the two driven units 334 are pulleys. The transmission component 335 is a belt. The transmission motor 3322 inputs power into the transmission decelerator 3321. The transmission decelerator 3321 drives the driving unit 333 and the transmission component 335. The transmission component 335 drives the two driven units 334 and makes the two reversing racks 322 rotate simultaneously.

With reference to FIGS. 6 and 7, the vacuum set 40 has a vacuum apparatus 41 and multiple hoses 42. Each hose 42 has two opposite ends. One of the ends of each hose 42 is connected to and communicates with the vacuum apparatus 41, and the other end of each hose 42 is connected to and communicates with one of the hollow units 3231.

Figure 9:
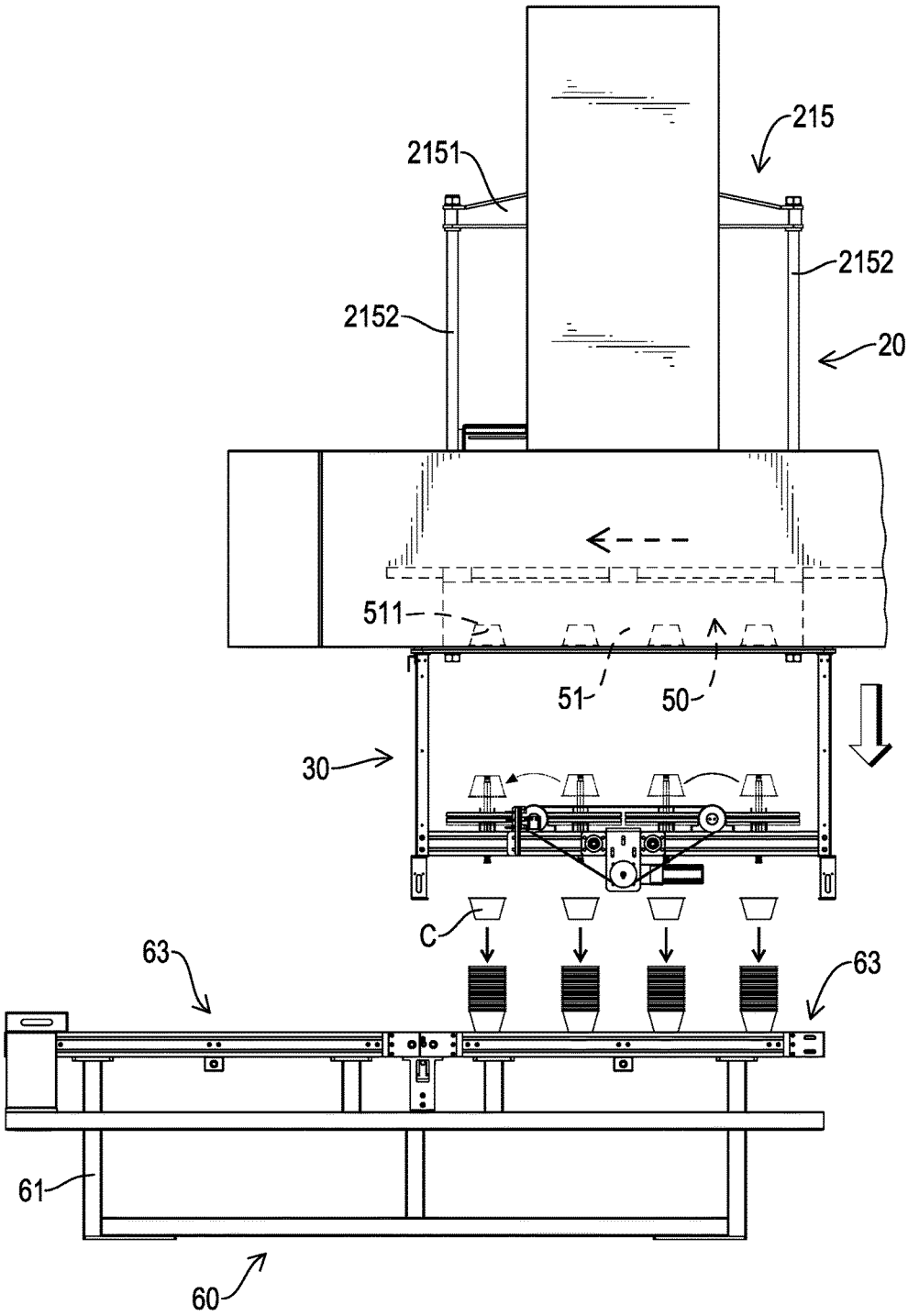
FIG. 9 is an enlarged operational side view of the paper pulp molding device in FIG. 1.
Figure 10:
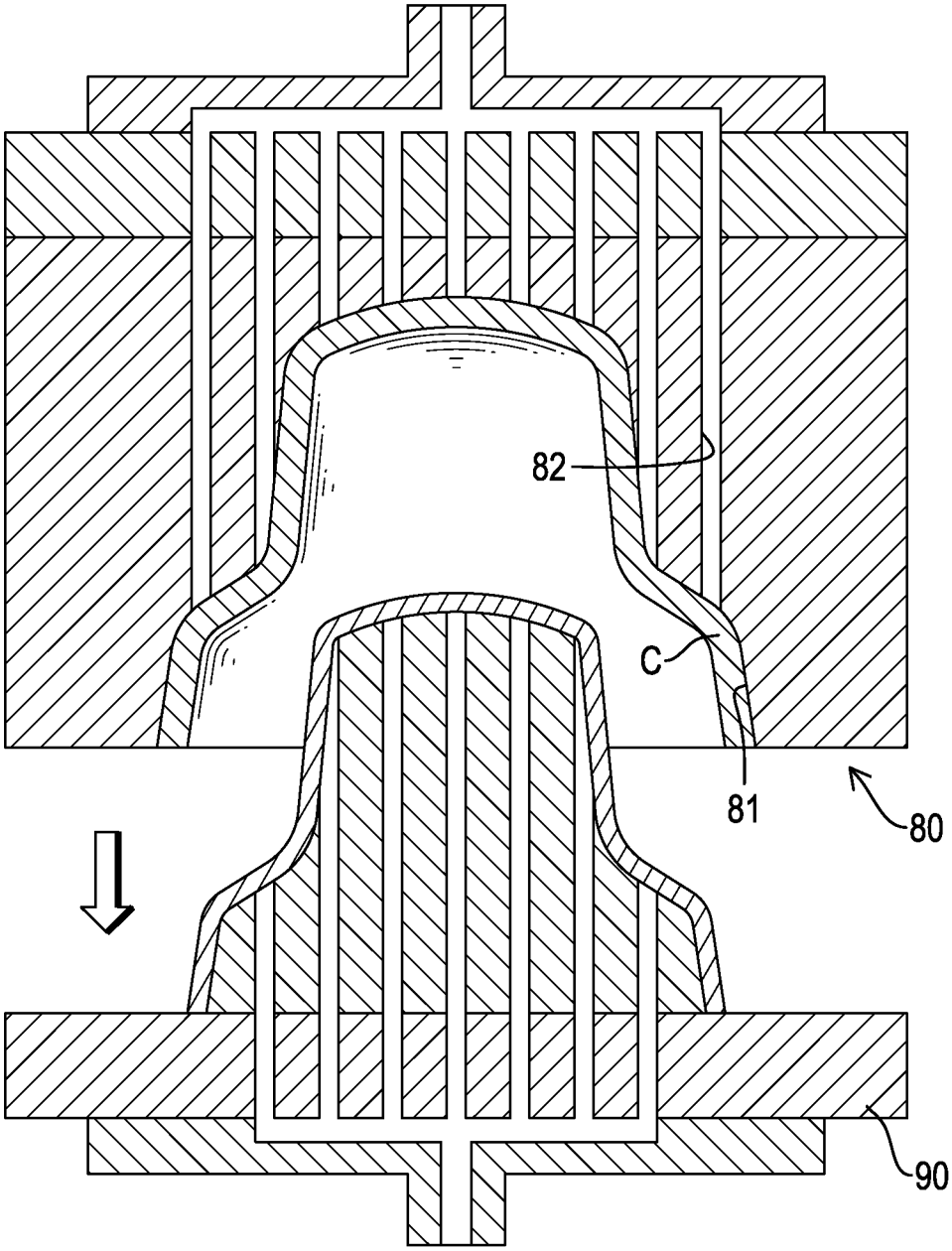
FIG.10 PRIOR ART
FIG. 10 is an operational cross sectional side view of a compression molding process of a conventional paper pulp molding device.
Figure 11:
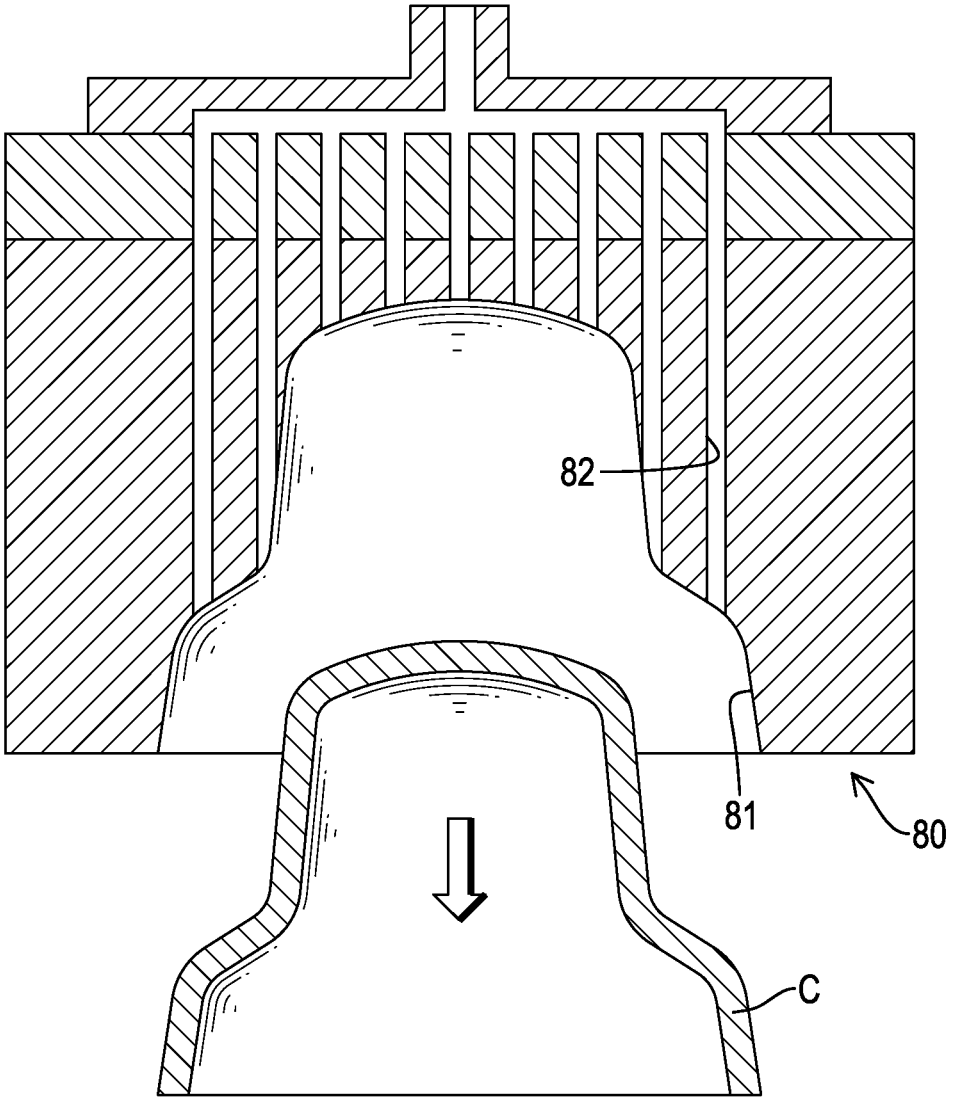
FIG.11 PRIOR ART
FIG. 11 is an operational cross sectional side view of the compression molding process of the conventional paper pulp molding device in FIG. 10.

With reference to FIGS. 1, 2, and 9, the molding mechanism 50 has a setting height, an upper die 51, and a lower die 52. The setting height of the molding mechanism 50 is higher than the assembling height of the reversing demolding mechanism 30. The upper die 51 is movably assembled on the molding machine 10 and is capable of moving to a position corresponding to the reversing demolding mechanism 30. The upper die 51 has multiple cavities 511 facing to the reversing demolding mechanism 30. The cavities 511 respectively correspond in position to the multiple sucking structures 323 of the at least one suction set 32.

Figure 8:
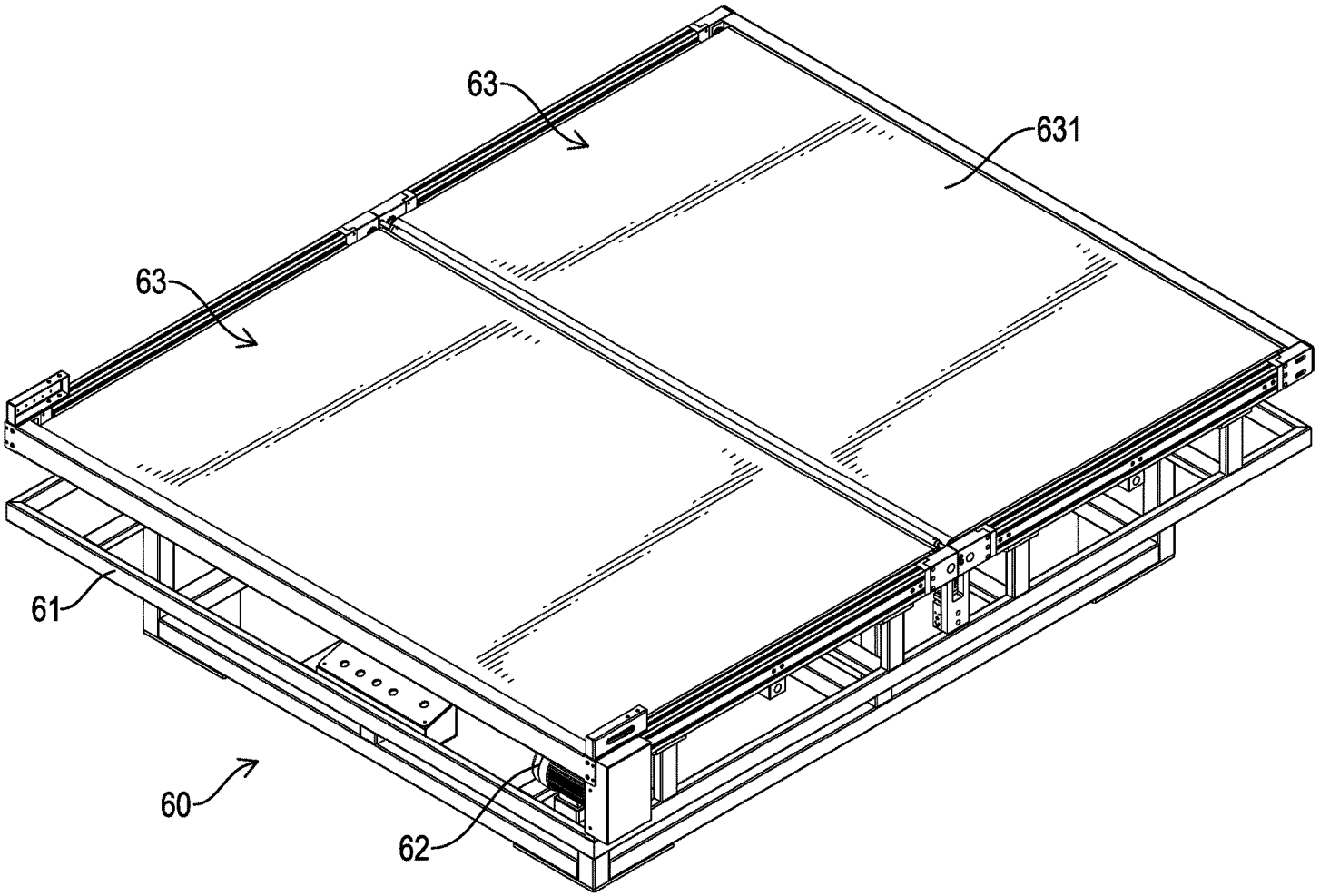
FIG. 8 is an enlarged perspective view of a conveyor of the paper pulp molding device in FIG. 1.

With reference to FIGS. 1 and 8, the conveyor 60 is below the reversing demolding mechanism 30 and has a main frame 61, a conveyor motor 62, and two transporting sets 63. The conveyor motor 62 and the two transporting sets 63 are assembled on the main frame 61. Each transporting set 63 has a transporting belt 631. The two transporting belts 631 of the two transporting sets 63 are driven by the conveyor motor 62.

With reference to FIGS. 6, 7, and 9, multiple containers C are left in the multiple cavities 511 of the upper die 51 after the molding process. The upper die 51 with the multiple containers C is moved along an axis extending from the front end of the molding machine 10 to the rear end of the molding machine 10 and is above the reversing demolding mechanism 30. The reversing demolding mechanism 30 is driven by the elevating mechanism 20 and is moved upward. The multiple sucking structures 323 respectively contact the multiple containers C and suck the multiple containers C by the multiple vacuum suction discs 3232.

With reference to FIGS. 6, 7, and 9, the vacuum suction discs 3232 suck the containers C by the suction force that is produced by the vacuum apparatus 41 of the vacuum set 40. The reversing demolding mechanism 30 is then moved downward, the two reversing racks 322 are simultaneously rotated half-turn, and the vacuum suction discs 3232 face to the conveyor 60. Finally, the vacuum apparatus 41 stops producing suction force and the containers C are dropped on the transporting belt 631 for transporting.

Each sucking structure 323 of the suction set 32 enlarges the contact area by each vacuum suction disc 3232 to reinforce the suction force that is produced by the vacuum apparatus 41. The reversing demolding mechanism 30 can facilitate detachment of the containers C from the cavities 511 of the upper die 51, and prevent the containers C from being left in the cavities 511 of the upper die 51 and interfering with the next molding process.

What is claimed is:

1. A paper pulp molding device comprising:

a molding machine having a front end and a rear end opposite to the front end of the molding machine;

an elevating mechanism assembled on the molding machine;

a reversing demolding mechanism having an assembling height;

a mounting rack assembled on and driven upwardly and downwardly by the elevating mechanism;

a transmission set assembled on the mounting rack; and at least one suction set, each one of the at least one suction set having a reversing rack pivotally assembled on the mounting rack and driven by the transmission set; and multiple sucking structures separately assembled on the reversing rack, each sucking structure having a hollow unit having two opposite ends, one of the ends of the hollow unit assembled on the reversing rack; and a vacuum suction disc assembled on the other end of the hollow unit;

a vacuum set having a vacuum apparatus; and multiple hoses, each hose having two opposite ends, one of the ends of the hose connected to the vacuum apparatus, the other end of the hose communicating with the hollow unit of one of the sucking structures;

a molding mechanism having a setting height higher than the assembling height of the reversing demolding mechanism;

an upper die movably assembled on the molding machine and capable of moving to a position corresponding to the reversing demolding mechanism;

multiple cavities facing to the reversing demolding mechanism and respectively corresponding in position to the multiple sucking structures of the at least one suction set.

2. The paper pulp molding device as claimed in claim 1, wherein the molding machine further has a driving side; and an operating side opposite to the driving side;

the mounting rack has two opposite sides;

each reversing rack of each one of the at least one suction set has a pivot member having a first end facing to the driving side of the molding machine;

a second end opposite the first end of the pivot member and facing to the operating side of the molding machine, wherein the first end and the second end of the pivot member are respectively and rotatably assembled on the two sides of the mounting rack; and a rack body assembled on the pivot member, the hollow unit of each sucking structure of each one of the at least one suction set assembled on the rack body of the reversing rack of each one of the at least one suction set.

3. The paper pulp molding device as claimed in claim 2, wherein the transmission set of the reversing demolding mechanism is arranged on the driving side of the molding machine and has a transmission apparatus assembled on the mounting rack;

a driving unit assembled on the transmission apparatus;

at least one driven unit, each one of the at least one driven unit respectively and non-rotatably assembled on the first end of the pivot member of the reversing rack of each one of the at least one suction set; and a transmission component assembled around the driving unit and the at least one driven unit.

4. The paper pulp molding device as claimed in claim 3, wherein the at least one suction set is implemented as two in amount, and the two suction sets are arranged side by side; and the at least one driven unit is implemented as two in amount.

5. The paper pulp molding device as claimed in claim 4, wherein the driving unit and the two driven units are pulleys and the transmission component is a belt.

* * * * *